US005515059A

United States Patent [19]

How et al.

[11] Patent Number: 5,515,059

[45] Date of Patent: May 7, 1996

[54] ANTENNA ARRAY HAVING TWO DIMENSIONAL BEAM STEERING

[75] Inventors: Hoton How, Malden; Carmine Vittoria, Boston, both of Mass.

[73] Assignee: Northeastern University, Boston, Mass.

[21] Appl. No.: 189,185

[22] Filed: Jan. 31, 1994

[51] Int. Cl.[6] ..... H01Q 3/22; H01Q 1/00

[52] U.S. Cl. ..... 342/372; 343/787

[58] Field of Search ..... 342/371, 372, 342/70, 71; 343/711, 713, 715, 745, 746, 787

[56] References Cited

U.S. PATENT DOCUMENTS

| | | | |
|---|---|---|---|
| 3,013,266 | 12/1961 | Wheeler | 342/365 |
| 3,369,242 | 2/1968 | Johnson | 343/754 |
| 3,534,374 | 10/1970 | Johnson | 343/768 |
| 3,553,733 | 1/1971 | Buck | 342/371 |
| 3,716,854 | 2/1973 | Charlot, Jr. | 343/5 PD |
| 3,811,128 | 5/1974 | Munson | 343/787 |
| 3,924,204 | 12/1975 | Fasche et al. | 333/21 R |
| 4,001,834 | 1/1977 | Smith | 343/754 |
| 4,117,494 | 9/1978 | Frazita | 343/844 |
| 4,241,352 | 12/1980 | Alspaugh et al. | 343/700 |
| 4,254,383 | 3/1981 | Wolfe | 333/164 |
| 4,588,994 | 5/1986 | Tang et al. | 343/754 |
| 4,785,304 | 11/1988 | Stern et al. | 343/770 |
| 4,857,840 | 8/1989 | Lanchais | 324/207 |
| 4,879,562 | 11/1989 | Stern et al. | 343/700 |
| 4,881,052 | 11/1989 | Stern et al. | 333/24.1 |
| 4,887,054 | 12/1989 | Stern et al. | 333/158 |
| 4,933,680 | 6/1990 | Shapiro et al. | 343/700 MS |
| 5,008,678 | 4/1991 | Herman | 342/158 |
| 5,014,070 | 5/1991 | Stock et al. | 343/700 MS |
| 5,057,106 | 10/1991 | Kasevich et al. | 606/33 |
| 5,223,808 | 6/1993 | Lee et al. | 333/24.1 |

OTHER PUBLICATIONS

Fay, C. E., "Operation of the Ferrite Junction Circulator", *IEEE Transactions, on Microwave Theory & Techniques,* 1965, pp. 15–27.

Derneryd, Anders G., "A Theoretical Investigation of the Rectangular Microstrip Antenna Element", *IEEE Transactions on Antennas and Propagation* vol. AP–26 No. 4 Jul. 1978, pp. 532–535.

Lo, Y. T., "Theory and Experiment on Microstrip Antennas", *IEEE Transactions on Antennas and Propagation,* vol. 27, Mar. 1979, 137–145.

Rana, Inam E., "Current Distribution and Input Impedance of Printed Dipoles", *IEEE Transactions on Antennas and Propagation,* vol. AP–29, No. 1, Jan. 1981, pp. 99–105.

How, H., "Novel Filter Design Incorporation Asymmetrical Stripline Y–Junction Circulators", *IEEE Transactions on Microwave Theory and Techniques,* vol. 39, No. 1, Jan. 1991, pp. 40–46.

Pozar, David M., "RCS Reduction for a Microstrip Antenna Using a Normally Biased Ferrite Substrate", *IEEE Microwave and Guided Wave Letters,* vol. 2, No. 5, 1992, pp. 196–198.

Pozar, D. M., "Magnetic Tuning of a Microstrip Antenna on a Ferrite Substrate," Electron. Lett., vol. 24, Jun. 9, 1988, pp. 729–731.

(List continued on next page.)

*Primary Examiner*—Gregory C. Issing

*Attorney, Agent, or Firm*—Weingarten, Schurgin, Gagnebin & Hayes

[57] ABSTRACT

An array antenna includes a ferrite substrate having a two-dimensional planar array of antenna elements disposed over a first surface thereof and means for applying an external magnetic field having a magnitude and direction which can be varied at least in a plane in which the antenna elements lie. The amplitude and direction of the external magnetic biasing field is varied to control the relative phases between each of the plurality of antenna elements and to steer the direction of a main antenna beam in two dimensions.

18 Claims, 5 Drawing Sheets

OTHER PUBLICATIONS

Shen, L. C., "Resonant Frequency of a Circular Disc, Printed Circuit Antenna," *IEE Transactions on Antennas and Propagation,* Jul., 1977, pp. 595–596.

Watkins, J. "Circular Resonant Structures in Microstrip," *Electronic Letters,* vol. 5, No. 21, Oct., 1969 p. 524.

How, H., et al. "Radiation Frequencies of Ferrite Patch Antennas, *Electronics Letters,*" Jul. 15, 1992, vol. 28 No. 15 pp. 1405–1406.

Buris, N. E. et al., "Dipole Arrays Printed on Ferrite Substrates," *IEEE Transactions on Antennas and Propagation,* vol. 41, No. 2, Feb., 1993. pp. 165–175.

Buris, "Dipole Arrays Printed on Ferrite Substrates", IEEE Trans. on Antennas & Prop. vol. 41 No. 2 Feb. 1993.

Henderson, "Magnetised Microstrip Antenna with Pattern Control" Electron. Letters vol. 24 pp. 45–47, 1988.

ANTENNA ARRAY HAVING TWO DIMENSIONAL BEAM STEERING

FIELD OF THE INVENTION

This invention relates to antennas and more particularly to ferrite antennas, which may be used in vehicle collision avoidance systems.

BACKGROUND OF THE INVENTION

As is known in the art, automotive sensors may generally provide engine control, stability or suspension control, and outer situation monitoring. Among these, outer situation monitoring may be provided from an automobile radar disposed on a vehicle. Such radars are generally referred to as vehicle collision avoidance systems. Such systems aid a driver for example by warning the driver of an incoming object. As a warning sensor, or so-called anti-collision radar, the radar should be able to detect objects at a relatively long distance in contrast to a short range sensor which may be useful for parking, for example. Such anti-collision radars may be used on a variety of vehicles including but not limited to cars, trucks, and buses.

To provide a radar having a relatively long range detection capability, signals in the infrared and millimeter wave frequency ranges may be used. Millimeter wave frequency signals are generally preferred since they are relatively unattenuated by adverse weather conditions such as fog, rain, or snow. Furthermore, RF signals in the millimeter wave frequency range are substantially unaffected by road dust which may adhere to an antenna.

The presently assigned frequency ranges for automotive anti-collision radars vary from country to country. For example, in Europe the present frequency range is about 77 GHz, in Japan 60 GHz, and in the United States 24 GHz. One problem with anti-collision radar antennas used today, however, is that they fail to have steerable antenna beams.

One solution to this problem is to provide an anti-collision system having an electronically controlled phased array antenna. Electronically controlled phased array antennas typically have relatively high development and manufacturing costs, are susceptible to damage, and can be relatively difficult, expensive and time consuming to repair. Thus, it would be desirable to provide a relatively simple, robust antenna for some applications in which phased arrays are used.

One approach is to provide an antenna having discrete ferrite phase shifting circuits coupled thereto. Ferrite materials, however, have not generally been used in antenna apertures as either a radiator or a scatterer to provide electronic control of the antenna.

As is also known, there has been a trend to fabricate antennas which operate at relatively high RF frequencies including those frequencies in the so-called millimeter wave (MMW) or Ka-band frequency range. Conventional MMW beam techniques which provide an antenna having beam steering capabilities involve the use of periodic structures or scatterers which are provided as conductive gratings, diodes, or varactors. Alternatively, electronic steering may be provided by using delay lines having relatively small delay times (e.g. less than 1 nanosecond) at MMW frequencies.

Conventional two dimensional electronic steerable MMW antennas are generally constructed using delay lines which control the phases of each individual element in an antenna array. However, at MMW frequencies the wavelengths are small and the adjustment of the amount of phase shifts for an array becomes a formidable task.

It would thus be desirable to provide an array of antennas which may be incorporated into an anti-collision radar system and which has a steerable antenna beam. It would also be desirable to provide an alternative way to construct two dimensional steerable antennas for use in an anti-collision radar.

SUMMARY OF THE INVENTION

In accordance with the present invention, an array antenna includes a ferrite substrate having a conductor disposed over a first surface thereof. The conductor is provided having openings formed therein to provide a plurality of antenna elements disposed over the first surface of the substrate. A plurality of dielectric image lines are disposed on the conductor to provide feeder lines for feeding the plurality of antenna elements. The array antenna further includes means for applying an external magnetic field having a magnitude and direction, wherein the magnitude and direction of the external magnetic field can be varied in a plane in which the antenna elements lie and wherein the relative phases between each of the plurality of antenna elements are controlled by varying the amplitude and direction of the external magnetic biasing field in the plane. With this particular arrangement, an antenna array which radiates an antenna beam steerable in two directions and which is relatively simple to fabricate is provided. The means for applying the external magnetic biasing field may be provided as a pair of orthogonally disposed Helmholz coils. The relative phases between each of the antenna elements are controlled by the external magnetic biasing field which can be varied both in amplitude and direction in a plane. Consequently, the direction in which the main beam of the antenna radiates can be controlled by varying the magnitude and direction of the externally applied magnetic field provided by two orthogonally disposed Helmholz coils. Thus a steerable antenna which does not require conventional delay line circuits is provided. Furthermore, since the antenna also does not require electronic circuits, a relatively robust antenna is provided. Moreover, since, dielectric image lines are efficient transmission lines at high frequencies this particular arrangement is preferred for use in the millimeter wave (MMW) frequency range. The steering rates of the antenna are typically in the range of about a few Oersteds (Oe) per steering degree.

In accordance with a further aspect of the present invention an antenna includes a ferrite substrate having a plurality of conductors disposed over a first surface thereof to provide a plurality of antenna elements each having a circular shape. The antenna further includes a plurality of feeder lines which are disposed on the substrate and coupled to the antenna elements. The antenna further includes means for applying an external magnetic field having a magnitude and direction, wherein the magnitude and direction of the external magnetic field can be varied in a plane in which the antenna elements are disposed and wherein the relative phases between each of said plurality of antenna elements are controlled by varying the amplitude and direction of the external magnetic biasing field in the plane and wherein by changing the amplitude and direction of the in-plane magnetic biasing field, the radiation beam from the antenna array is steered. With this particular arrangement, an antenna array which radiates an antenna beam steerable in two directions and which is relatively simple to fabricate is provided. The antenna elements are provided as microstrip patches disposed on the ferrite substrate and which radiate electromagnetic energy. The antenna elements are preferably disposed in close proximity to feeder lines. Thus a steerable antenna which does not require conventional delay line circuits is provided. Furthermore, since the antenna also does not require relatively delicate electronic circuits, a relatively robust antenna is provided. The means for applying the external magnetic biasing field may be provided as a pair of orthogonally disposed Helmholz coils. The relative phases between antenna elements are controlled by the external magnetic biasing field which can be varied both in amplitude and direction in a plane. Thus, the direction in which the main beam of the antenna radiates can be controlled by varying the magnitude and direction of the externally applied magnetic field provided by the two orthogonally disposed Helmholz coils. Since the radiation pattern for each of the antenna elements depends on the magnetization state of the ferrite substrate, the overall radiation profile from the array antenna is a function of the applied external magnetic field. Therefore, by changing the amplitude and direction of the in-plane magnetic biasing field, the radiation beam from the ferrite antenna array can be steered.

In accordance with a still further aspect of the present invention, a leaky wave antenna includes two pairs of corrugated dielectric image lines formed on a ferrite substrate with a first one of the pair of lines disposed orthogonal to a second one of the pair of lines. The antenna further includes means for applying an external magnetic field having a magnitude and direction, wherein the magnitude and direction of the external magnetic field can be varied in a plane and wherein the relative phases between each of said two pairs of corrugated dielectric image lines are controlled by varying the amplitude and direction of the external magnetic biasing field in a plane and wherein by changing the amplitude and direction of the in-plane magnetic biasing field, the radiation beam from the antenna array is steered. With this particular arrangement by adjusting the direction and amplitude of the in-plane biasing magnetic field, the radiation beam from the leaky wave structure can be steered in two dimensions. The steering rate of the antenna beam is typically in the range of about one degree per 340 Oe at an operating frequency typically of about 50 Ghz. The means for applying the external magnetic field may be provided as two orthogonally disposed Helmholz coils and the two sets of corrugated dielectric image lines may be fabricated using a wet etching technique.

In accordance with a still further aspect of the present invention, an antenna includes a waveguide horn antenna having first and second apertures, a substrate having first and second opposing surfaces disposed in a first one of the waveguide horn apertures, and an array of ferrite discs disposed on a first one of the first and second surfaces of the substrate. The ferrite discs scatter radiation fields from the waveguide horn. With this particular arrangement, a waveguide antenna which is steerable in two dimensions using ferrite elements is provided. The waveguide antenna may be provided as a waveguide horn antenna responsive to RF signals in the MMW frequency range. The ferrite discs scatter the radiation provided from the horn antenna. By applying an external magnetic field in the horizontal and vertical directions the magnetization state of the ferrite can be altered. This results in two dimensional steering of the beam of radiation. By increasing the number of ferrite scatterers, the discrete angles at which the antenna beam may be steered can be minimized. The antenna may further include means for applying an external magnetic field in the plane in which the ferrite discs are disposed wherein the external magnetic field may be applied in the horizontal and vertical directions to alter the magnetization state of the ferrite discs. The ferrite discs may be disposed in a two dimensional array pattern and the substrate on which the discs are disposed may be provided from Teflon or other low dielectric plastics. The substrate may then be disposed in front of the first aperture of the waveguide horn antenna. The means for applying an external magnetic field may be provided as two orthogonally disposed Helmholz coils. The orthogonally disposed Helmholz coils provide the external magnetic field in horizontal and vertical directions. The external magnetic field alters the magnetization state of the ferrite discs thereby changing the direction of a main beam of said antenna array.

BRIEF DESCRIPTION OF THE DRAWINGS

The foregoing features of this invention as well as the invention itself may be more fully understood from the following detailed description of the drawings in which.

DESCRIPTION OF THE PREFERRED EMBODIMENTS

Figure 1:
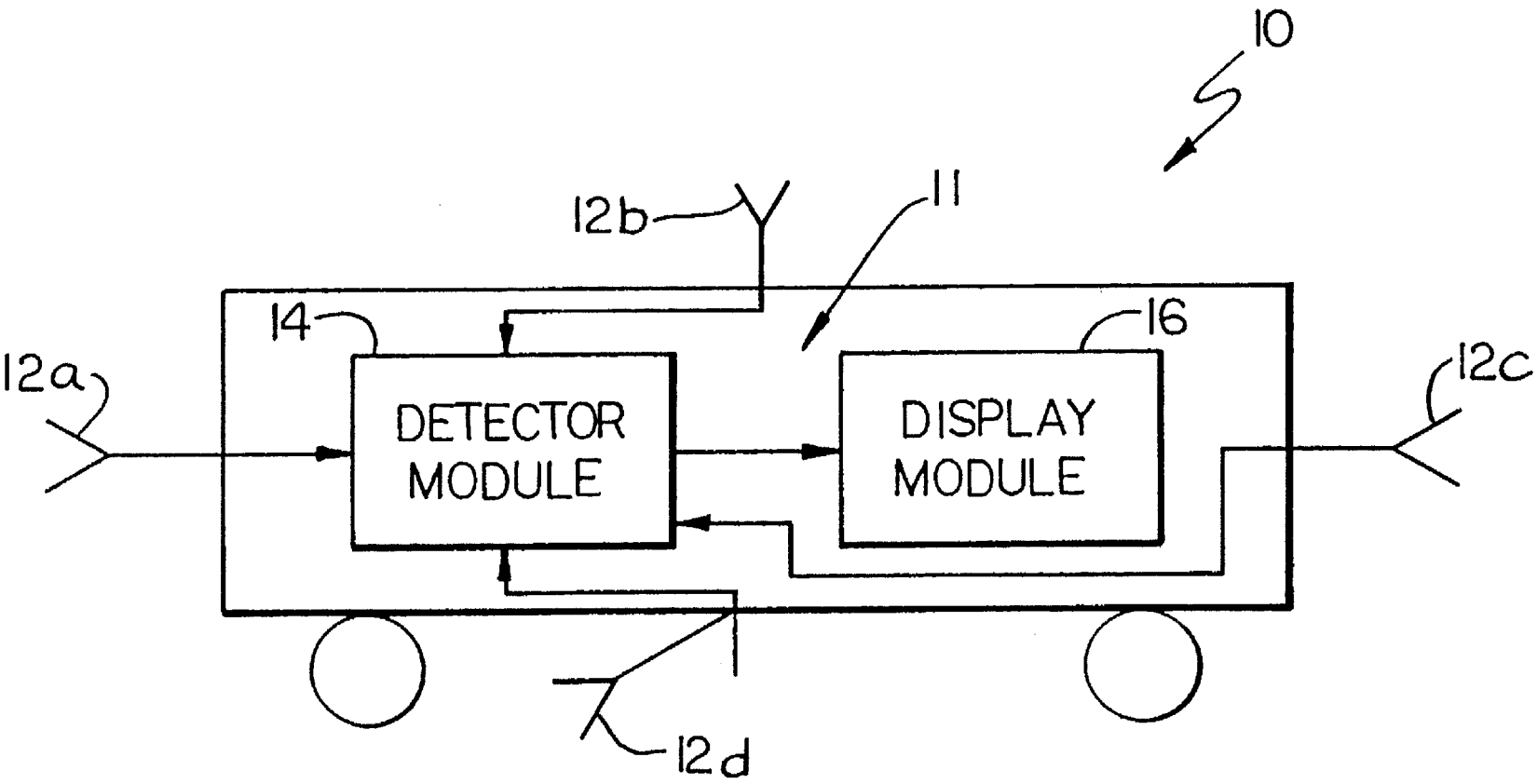
FIG. 1 is a block diagram of a vehicle having a vehicle collision avoidance system disposed thereon.

Referring now to FIG. 1, a vehicle 10 is provided having an anti-collision avoidance radar system 11 disposed thereon. Vehicle 10 may be provided as any type of vehicle including but not limited to a car, a truck or a bus. Anti-collision avoidance radar system 11 includes a plurality of antennas 12*a*–12*d* generally denoted 12 coupled to detector and display modules 14, 16. Antennas 12 may be provided as the types described in detail in conjunction with FIGS. 2–5 below.

Antennas 12 are coupled to a detector module 14. Detector module 14 receives signals fed thereto from antennas 12 and determines whether any objects are approaching vehicle 10. Detector 14 provides signals to display module 16. Display module 16 may include either or both an audio display (e.g. a speaker) and a visual display (e.g. a light emitting diode or liquid crystal diode display).

Anti-collision radar 10 should preferably be able to perform a plurality of different functions. For example, it is preferable for radar 10 to recognize an object in front of the vehicle. Such objects may include cars, trucks, or even pedestrians for example. The object is thus "locked in" by the radar once recognized.

Anti-collision system 11 should preferably be capable of determining and continuously monitoring the position and speed of a "locked-in" object regardless of the location of the object with respect to the vehicle.

Furthermore, anti-collision radar system 11 is preferably capable of monitoring road conditions and providing an indication of road conditions and of changes in road conditions. For example, anti-collision radar 10 may indicate when a road is curved, sloped, or bumpy.

All of the above features can be obtained by providing anti-collision radar system 11 as a frequency modulated pulsed radar having two-dimensional steering. As will be described further below in conjunction with FIGS. 2–5, two-dimensional electronic steering MMW antennas can be most conveniently constructed using ferrite materials. Furthermore, to increase the sensitivity of the radar, circularly polarized antennas may offer advantages over linearly polarized antennas. That is, during adverse weather conditions, snow and rain can scatter emitted radar signals and alter the polarization of the transmitted signals. Thus, in linearly polarized systems, polarization mismatch may occur during reception of the reflected signals and hinder system performance.

A ferrite patch antenna having a circular shape radiates circularly polarized waves. The radiation frequencies of such an antenna can be tuned/modulated by adjusting the external magnetic biasing field. As will be described further below in conjunction with FIGS. 2 and 3, this can be achieved for example by applying a magnetic biasing field normal to the ferrite substrate.

A potentially significant problem for using future anti-collision radar systems is that of RF interference from other radar systems. When there are many radars operating in a narrow frequency range, RF interference will occur among all the signals. To be able to discern a particular RF signal from a large number of RF signals, each of the radar signals should be characterized using an identification scheme.

Ferrite patch antennas provide a unique option to achieve such signal identification. The ferrite patch antenna emits radiation signals having two different frequencies. These dual frequency radiation signals may be synchronized with respect to the modulation signals. Therefore, rather than checking a single frequency, the system can check the synchronization of the two frequencies and the radar signals can thus be unambiguously identified.

As will be described further below in conjunction with FIGS. 2 and 3, this can be achieved for example by applying a magnetic biasing field normal to the ferrite substrate.

Figure 2:
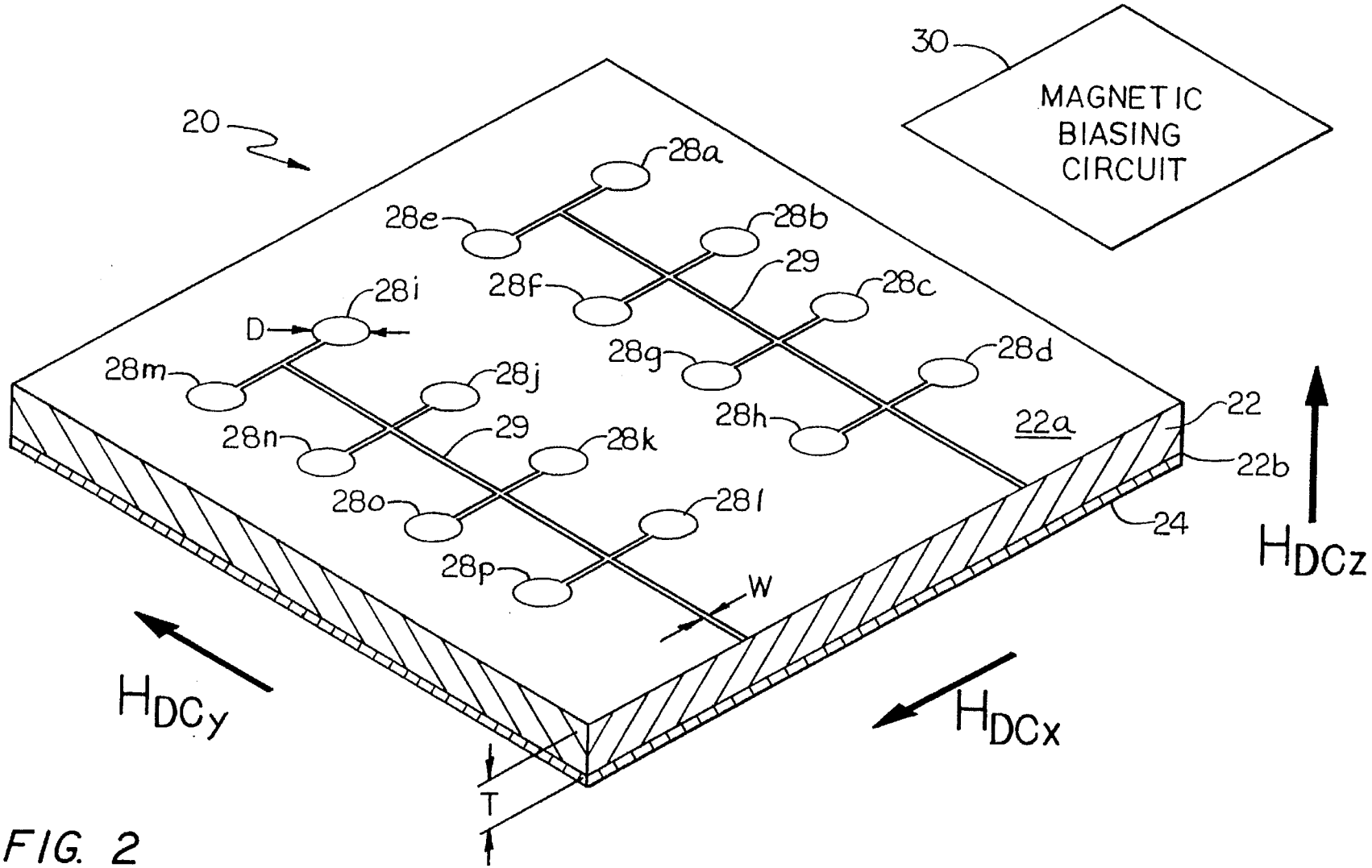
FIG. 2 is a perspective view of a microstrip line fed ferrite patch array antenna.

Referring now to FIG. 2, an array antenna 20 includes a ferrite substrate 22 having first and second opposing surfaces 22*a*, 22*b*. A ground plane conductor 24 is disposed over surface 22*b*. A plurality of conductive antenna elements 28*a*–28*p*, generally denoted 28, are disposed over surface 22*a*. It should be noted that although sixteen antenna elements 28 are here shown, more or fewer elements may be used. It should also be noted that it may in some applications be desirable to provide antenna arrays having rows and columns with a like number of elements.

Substrate 22 is provided having a thickness T typically in the range of about 0.100 inch. The particular thickness of substrate 22 is selected in accordance with a variety of factors including but not limited to the dielectric constant and saturation magnetization of the substrate, the desired frequency of operation and size and cost of the array.

Substrate 22 is provided from ferrite materials of both the hexagonal and cubic types. Hexagonal ferrites are the so-called Y-type ferrites. Y-type ferrite materials are self biased. That is, there exists an intrinsic magnetic field therein. Thus, a smaller external magnetic field may be used to change the permeability of substrate 22.

Antenna elements 28 are provided having a circular shape with a diameter D typically in the range of about 0.01 inch to 0.50 inch depending on the frequency range of the application. The particular diameter of antenna elements 28 are selected in accordance with a variety of factors including but not limited to the dielectric constant and saturation magnetization of the substrate and the desired frequency of operation and size and cost of the array.

Antenna elements 28 are disposed in close proximity to conductive feeder lines 29 having a width W typically in the range of about 0.005 inches to 0.025 inches. The particular width of feeder lines 29 are selected in accordance with a variety of factors including but not limited to the dielectric constant and saturation magnetization of the substrate, the desired frequency of operation and the diameter of elements 28 and impedance matching.

Array antenna 20 further includes means 30 for applying an external magnetic field. The external magnetic field is provided having a predetermined magnitude and direction to steer the antenna beam in a particular direction. The magnitude and direction of the external magnetic field can be varied via mean 30 in a plane in which the antenna elements 28 lie. The relative phases between each of the plurality of antenna elements 28 are controlled by varying the amplitude and direction of the external magnetic biasing field in the plane.

Means 30 may be provided, for example, as a pair of orthogonally disposed Helmholz coils. The relative phases between antenna elements 28 are controlled by the external magnetic biasing field which can be varied both in amplitude and direction in the X, Y and Z planes as shown in FIG. 2. Thus, the direction in which the main beam of the antenna radiates can be controlled by varying the magnitude and direction of the externally applied magnetic field provided by the two orthogonally disposed Helmholz coils.

By controlling the amplitude and direction of the external magnetic biasing field, antenna array 20 radiates an antenna beam which is steerable in two directions. Thus antenna 20 is provided as an electronically steerable antenna which does not require conventional delay line circuits. Furthermore, since antenna 20 does not require relatively delicate electronic circuits, it is a relatively robust antenna.

Three DC magnetic fields denoted as $H_{DCx}$, $H_{DCy}$, and $H_{DCz}$ are shown in FIG. 2. By changing the magnitude of $H_{DCx}$ only the resultant radiation beam will be scanned in the yz-plane, whereas change of $H_{DCy}$ will result in change of the beam scanning in the xz-plane. The scanning rates are typically in the range of about a few Oersteds per degree of beam scanning.

By exposing ferrite substrate 22 to a magnetic field, the permeability (μ) of substrate 22 is changed. By changing the substrate permeability, the electrical length of substrate 22 is also changed because the electrical length is inversely proportional to the square root of the substrate permeability. Thus this changes the electrical distance between antenna elements 28 in the array antenna 20.

By changing the electrical distance between elements 28, the phase relation between radiators is changed. The manner in which the RF fields emitted by each of the radiators add may be selected to steer the radiated antenna beam in a predetermined direction.

It is desirable to be able to change the direction of the beam as quickly as possible. To provide relatively fast beam steering, the smallest external magnetic biasing field possible should be used. This allows the antenna to have fast switching speeds and provides a relatively low cost system.

Cubic materials such as garnet and spinel materials are conventionally used to provide substrate 22. With cubic materials, as operating frequency increases a larger magnetic field is required to tune the antenna.

In the present invention, however, ferrite materials of both the hexagonal and cubic types are used. Hexagonal ferrites are the so-called Y-type ferrites. Y-type ferrite materials are self biased. That is, there exists an intrinsic magnetic field therein. Thus, a smaller external magnetic field may be used to change the permeability of the substrate and consequently antenna 28 is provided having a relatively fast switching and beam steering speeds and relatively low cost antenna system is provided.

Magnetic field $H_{DCz}$, which is in a direction normal to the plane in which the antenna elements lie, is introduced to provide antenna array 20 having circular polarization as well as frequency modulation of the radiated RF signal. $H_{DCz}$ may be used for frequency tuning and modulation of the radiated signals.

In those applications in which it may be desirable to provide a system having an RF signal identification scheme, as in the case for collision avoidance instrumentation described above in conjunction with FIG. 1 for example, $H_{DCz}$ results in splitting of the radiation frequencies which provides a natural way for identifying the radiation signals.

That is, the ferrite patch array antenna 20 emits radiation signals having two different frequencies. These dual frequency radiation signals may be synchronized with respect to the modulation signals. Therefore, the synchronization of the two frequencies can be examined and the radar signal can thus be unambiguously identified.

Figure 3:
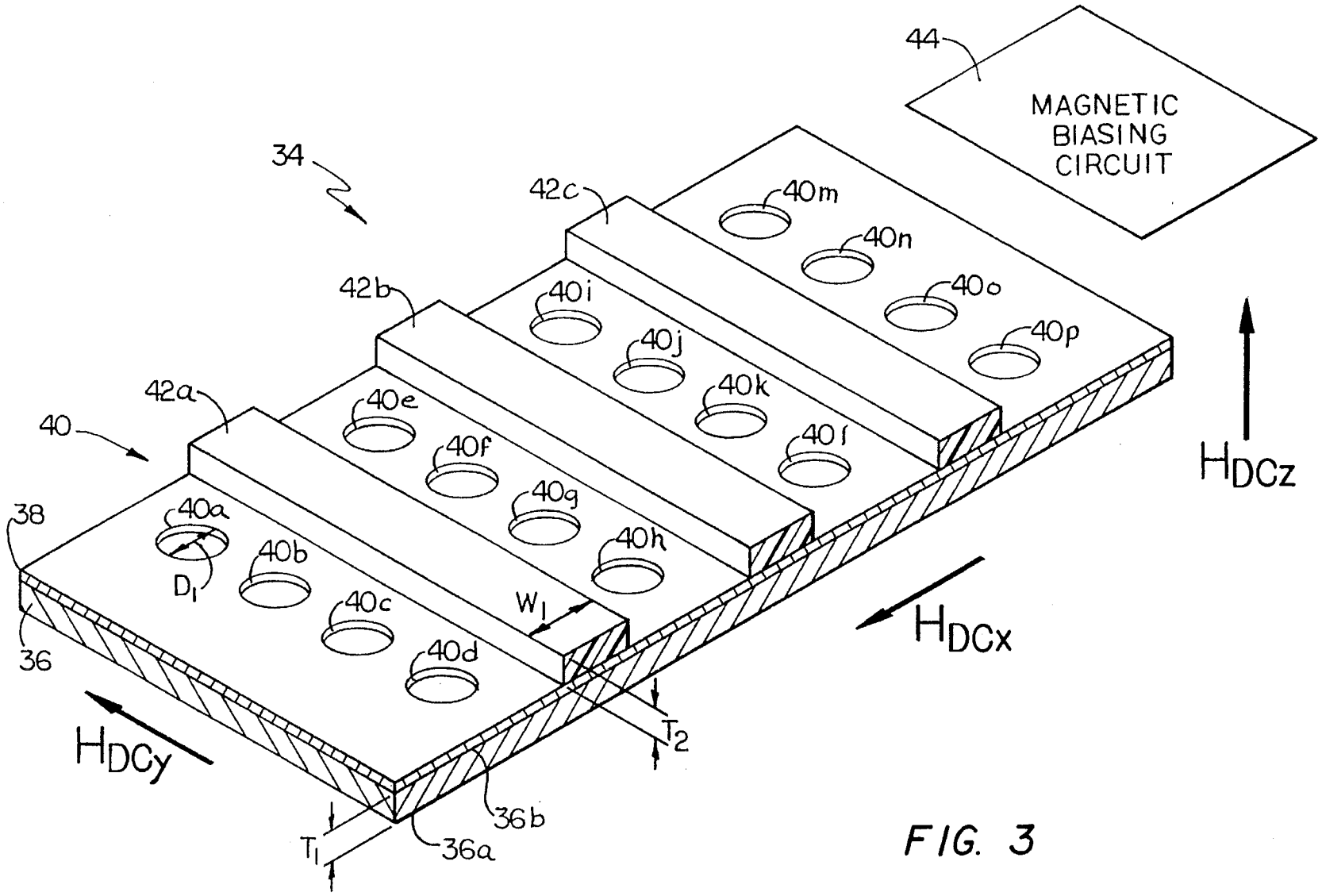
FIG. 3 is a perspective view of a microstrip line fed ferrite patch array antenna having dielectric image lines.

Referring now to FIG. 3, an array antenna 34 includes a ferrite substrate 36 having first and second opposing surfaces 36*a*, 36*b*. A conductor 38 is disposed over surface 36*b*. Portions of conductor 38 have been removed to provide a plurality of openings 40*a*–40*p*, generally denoted 40. Openings 40 are here provided having a circular shape and correspond to antenna elements disposed over surface 36*b* of substrate 36. It should be noted that although sixteen antenna elements 40 are here shown, more or fewer elements may be used.

Substrate 36 is provided having a thickness $T_1$ typically in the range of about 0.100 inch. The particular thickness of substrate 36 is selected in accordance with a variety of factors including but not limited to the dielectric constant and saturation magnetization of the substrate and the desired frequency of operation and size and cost of the array.

Substrate 36 is provided from ferrite materials of both the hexagonal and cubic types. Hexagonal ferrites are the so-called Y-type ferrites. Y-type ferrite materials are self biased. That is, there exists an intrinsic magnetic field therein. Thus, a smaller external magnetic field may be used to change the permeability of substrate 36.

Antenna elements 40 are provided having a circular shape with a diameter $D_1$ typically in the range of about 0.01 inch to 0.50 inch. The particular diameter of antenna elements 40 are selected in accordance with a variety of factors including but not limited to the dielectric constant and saturation magnetization of the substrate and the desired frequency of operation and size and cost of the array.

Antenna 34 further includes a plurality of dielectric image lines 42*a*–42*c* generally denoted 42 disposed on the ground plane to provide feeder lines for feeding the plurality of slot antenna elements 40. Feeder lines 42 are provided having a width $W_1$ typically in the range of about 0.04 inch to 0.39 inch, and a thickness $T_2$ typically in the range of about 0.004 inch to 0.120 inch. The particular width and thickness of feeder lines 42 are selected in accordance with a variety of factors including but not limited to the dielectric constant and saturation magnetization of substrate 36, the desired frequency of operation, the diameter of antenna elements 40 and the desired impedance match.

The antenna further includes means 44 for applying an external magnetic field having a magnitude and direction. Biasing circuit means 44 may be similar to biasing circuit means 30 described above in conjunction with FIG. 2.

Antenna array 34 may be electronically steered using the same principles described above in conjunction with FIG. 2. However, since image feeder lines 42 are low loss transmission lines at high frequencies, array 34 may be preferred for use in the millimeter wave frequency range.

Figure 4:
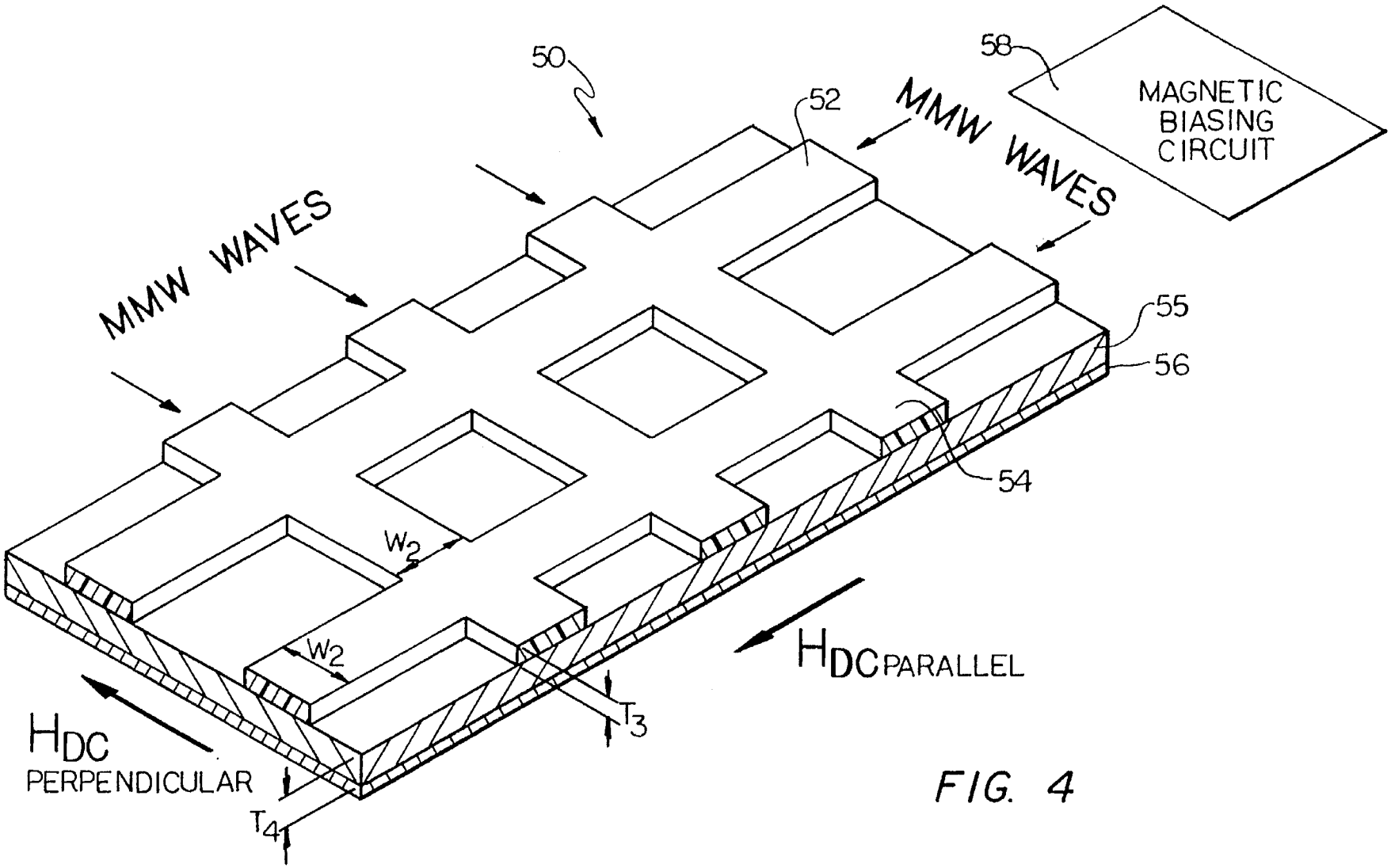
FIG. 4 is a ferrite patch array antenna having a two-dimensional leaky wave structure.

Turning now to FIG. 4 a leaky wave antenna 50 includes a first plurality of dielectric image lines 52 and a second plurality of dielectric image lines 54 disposed orthogonal to the first plurality of dielectric image lines 52 to thus provide a corrugated type structure. The image lines 52, 54 are disposed over a ferrite substrate 55, which is disposed over ground plane conductor 56. The two sets of corrugated dielectric image lines 52, 54 may be fabricated using a wet etching technique.

Image lines 52, 54 are provided having a width $W_2$ typically in the range of about 0.010 inch to 0.050 inch, and a thickness $T_3$ typically in the range of about 0.010 inch to 0.100 inch. The particular width and thickness of feeder lines 42 are selected in accordance with a variety of factors including but not limited to the dielectric constant and saturation magnetization of substrate 55, the desired frequency of operation and size and cost of the array. The ferrite substrate 55 has a thickness $T_4$ typically in the range of about 0.005 inch to 0.100 inch.

The antenna further includes means 58 for applying an external magnetic field having a magnitude and direction. Biasing circuit means 58 may be similar to biasing circuit means 30 and 44 described above in conjunction with FIGS. 2 and 3 respectively. For example, the means for applying the external magnetic field may be provided as two orthogonally disposed Helmholz coils. Thus, the magnitude and direction of the external magnetic field can be varied in predetermined planes to vary the relative phases between each of the corrugated ferrite image lines 52, 54.

By adjusting the direction and amplitude of the in-plane biasing magnetic field, the radiation beam from the leaky wave structure can consequently be steered in two dimensions. The steering rate of the antenna beam may typically be in the range of about one degree per 340 Oe at an operating frequency typically of about 50 Ghz. Antenna array 50 may thus be electronically steered using the same principles described above in conjunction with FIG. 2. Since image lines 52, 54 are low loss transmission lines at high frequencies, array 34 may be preferred for use at frequencies in the millimeter wave frequency range.

Two-dimensional leaky structure antenna 50 operates in the following manner. RF signals which may have frequencies in the millimeter frequency range, are fed from orthogonal directions into corrugated dielectric image lines 52, 54. The radiated electromagnetic field is directly related to the magnetization state of the ferrite substrate 55 biased by two horizontal magnetic fields denoted $H_{DC}$ perpendicular and $H_{DC}$ parallel. By varying the strength of these magnetic fields, it is believed the radiation beam can be scanned.

One problem with the leaky wave structure is that the scanning rate may be relatively high compared to other ferrite steering antenna configurations. This results in slow speed in scanning the radiation beam. However, leaky wave radiators emit radiations which cover very wide frequency spectra and thus this antenna configuration may be used over a relatively wide range of frequencies.

Figure 5:
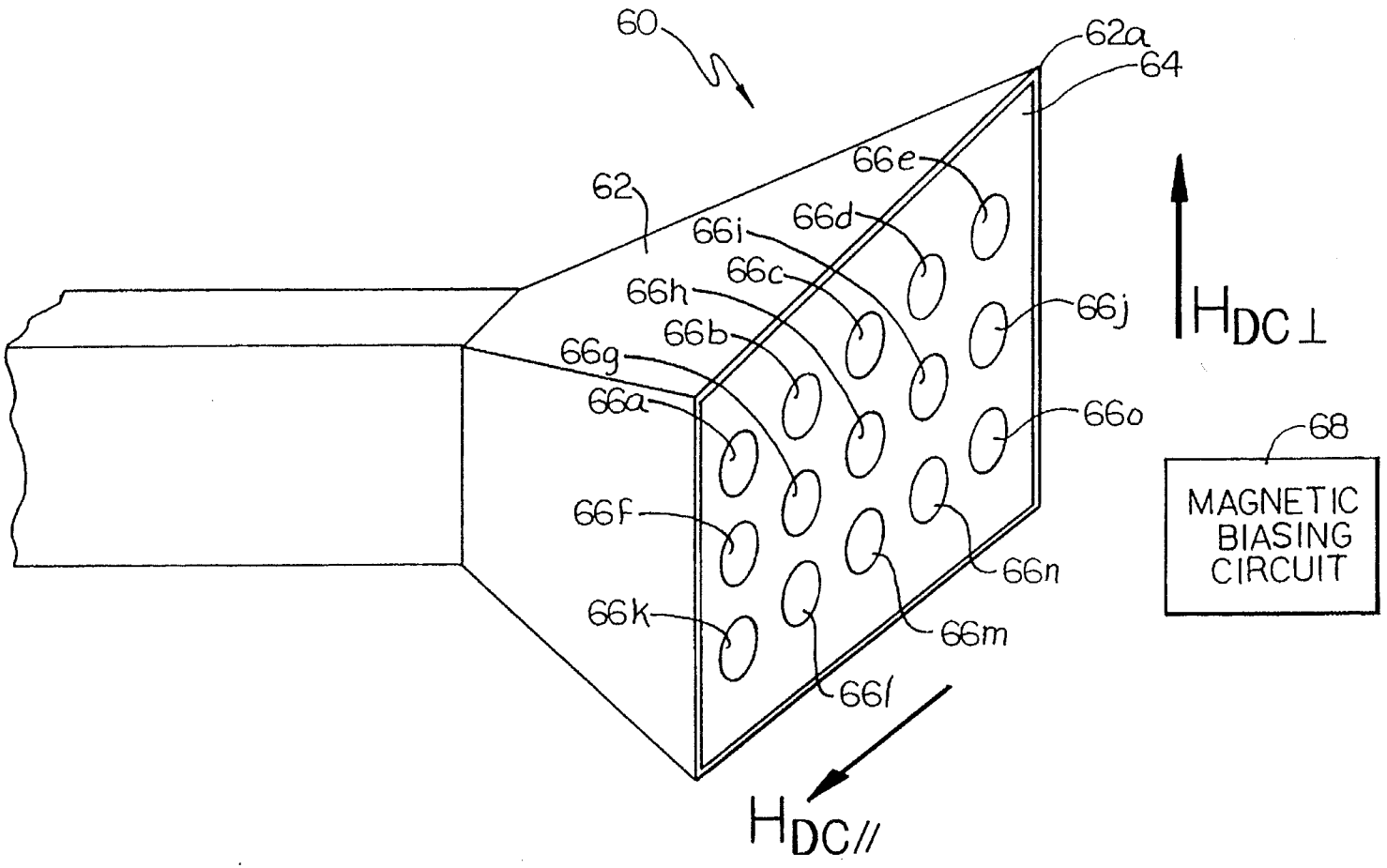
FIG. 5 is a two-dimensional array of ferrite scatterers disposed in an aperture of a waveguide horn antenna.

Referring now to FIG. 5 an antenna 60 includes a waveguide horn antenna 62 having an aperture 62*a*. The waveguide antenna 62 may be provided as a waveguide horn antenna responsive to RF signals in the MMW frequency range, for example. A substrate 64 is disposed in aperture 62*a* of waveguide horn 62. Substrate 64 may be provided from a low-dielectric material such as Teflon for example. Disposed on a first surface of substrate 64 is an array of ferrite discs 66*a*–66*o* generally denoted 66. Ferrite discs 66 scatter radiation fields which radiate from waveguide horn 62.

Antenna 60 further includes means 68 for applying an external magnetic field having a magnitude and direction. Biasing circuit means 68 may be similar to biasing circuit means 30 and 44 described above in conjunction with FIGS. 2 and 3, respectively.

For example, the means for applying the external magnetic field may be provided as two orthogonally disposed Helmholz coils.

By applying an external magnetic field in the horizontal and vertical directions the magnetization state of ferrite discs 66 can be altered. This results in two dimensional steering of the beam of radiation. By increasing the number of ferrite scatterers 66 the discrete angles at which the antenna beam may be steered can be minimized. That is it may be desirable to increase the number of scatterers 66 in the two dimensional array to minimize the scattering angle, and hence, increase the scanning resolution.

Having described preferred embodiments of the invention, it will now become apparent to one of skill in the art that other embodiments incorporating the concepts may be used. For example, two dimensional steerable MMW radars may be used in nondestructive evaluation of material flaws and structural defects in large bodies, for example, aircraft, ships, large buildings, and bridges. There are occasions where large bodies need to be evaluated nondestructively for routine check for normal maintenance.

However, it can be very time consuming and laborious if a body with large surface is to be checked in detail. In many instances nondestructive evaluation techniques are most useful when they are able to detect flaws which are invisible to the human eyes. Microwave techniques should be able to detect the size and the location of flaws imbedded in buildings, bridges, foundations, rotor blades, etc. There is, therefore, a need for nondestructive evaluation techniques for large bodies which perform the tasks reliably and conveniently.

MMW radars having antennas steerable in two-dimensions such as the types described herein may be used to scan the surface of large bodies. Through comparison between various patterns of material flaws and structural defects and reconstructed images of the radar signals one may readily distinguish the types of flaws and defects within the large bodies. For example, mechanical distortions, corrosion, pits, and scratches on the surfaces and loose joints can be detected in this manner. The evaluation processes can be automated though computers such that the scanning can be done in fine scales at high speeds to provide high resolution and reliability. Thus, the MMW ferrite patch antennas capable of two dimensional scanning described herein may be used to sense the flaw patterns of some known defects in large bodies.

Furthermore the ferrite patch antennas may be used as low-radar cross section antennas since their radar cross section can be significantly reduced by operating them near FMR.

It is felt, therefore, that these embodiments should not be limited to disclosed embodiments but rather should be limited only by the spirit and scope of the appended claims.

What is claimed is:

1. An antenna comprising:

a ferrite substrate having first and second opposing surfaces;

a two-dimensional planar array of antenna elements disposed over said first surface of said ferrite substrate, each of said antenna elements having a shape which is symmetric about a first axis;

a first magnetic circuit disposed proximate said two dimensional planar array of antenna elements, said first magnetic circuit having a first magnetic field with a first magnitude and a first direction, wherein the magnitude and direction of the first magnetic field can be varied in a plane in which the antenna elements lie, and wherein the relative phases between each of said antenna elements in said first direction are controlled by varying the amplitude and direction of the first magnetic field; and a second magnetic circuit orthogonally disposed relative said first magnetic circuit, said second magnetic circuit having a second magnetic field with a second magnitude and a second direction orthogonal to the direction of the first magnetic field, wherein the magnitude and direction of the second magnetic field can be varied in a plane in which the antenna elements lie, and wherein the relative phases between each of said antenna elements in said second direction are controlled by varying the amplitude and direction of the second magnetic field.

2. The antenna of claim 1 wherein said first and second magnetic circuits are provided as two orthogonally disposed Helmholz coils.

3. The antenna of claim 2 wherein said antenna elements are openings formed in a conductor disposed on the ferrite substrate and wherein the openings are biased by the two orthogonally disposed Helmholz coils.

4. The antenna of claim 3 wherein the openings are provided by removing predetermined portions of said conductor disposed on said first surface of said ferrite substrate and said openings are disposed proximate at least one feeder line, said at least one feeder line exciting said openings.

5. The antenna of claim 2 wherein said antenna elements are microstrip antenna elements disposed on the ferrite substrate wherein the microstrip antenna elements are biased by the two orthogonally disposed Helmholz coils.

6. The antenna of claim 5 wherein the microstrip antenna elements are provided by disposing a conductive material in a predetermined pattern on the first surface of said ferrite substrate and said microstrip antenna elements are disposed proximate at least one feeder line, said at least one feeder line exciting said microstrip antenna elements.

7. An antenna comprising:

a ferrite substrate having first and second opposing surfaces;

a plurality of antenna elements disposed over said first surface of said ferrite substrate, each of said antenna elements having a circular shape and disposed to provide a two-dimensional planar array of antenna elements;

a plurality of dielectric image lines as feeder lines for feeding said plurality of antenna elements;

a first magnetic circuit disposed proximate said plurality of antenna elements, said first magnetic circuit having a first magnetic field with a first magnitude and a first direction, wherein the magnitude and direction of the first magnetic field can be varied in a plane in which the antenna elements lie, and wherein the relative phases between each of said plurality of antenna elements in said first direction are controlled by varying the amplitude and direction of the first magnetic field; and a second magnetic circuit orthogonally disposed relative said first magnetic circuit, said second magnetic circuit having a second magnetic field with a second magnitude and a second direction orthogonal to the direction of the first magnetic field, wherein the magnitude and direction of the second magnetic field can be varied in a plane in which the antenna elements lie, and wherein the relative phases between each of said antenna elements in said second direction are controlled by varying the amplitude and direction of the second magnetic field, wherein by changing the amplitude and direction of the magnetic field of the first and second magnetic circuits, the radiation beam from the antenna array is steered.

8. The antenna of claim 7 wherein said first and second magnetic circuits are provided as two orthogonally disposed Helmholz coils.

9. The antenna of claim 8 wherein said antenna elements are disposed such that each row and column of said array include an equal number of said antenna elements.

10. A leaky wave antenna comprising:

a ferrite substrate having first and second opposing surfaces;

two sets of corrugated dielectric image lines disposed over said first surface of said ferrite substrate, wherein image lines in a first one of said sets are disposed orthogonal to image lines in a second one of said sets;

a first magnetic circuit disposed proximate said substrate, said first circuit having a first magnetic field with a first magnitude and a first direction, wherein the magnitude and direction of the first magnetic field can be varied in a plane in which the two sets of corrugated dielectric image lines lie, and wherein the relative phases between each of said two sets of corrugated dielectric image lines in said first direction are controlled by varying the amplitude and direction of the first magnetic field; and a second magnetic circuit orthogonally disposed relative said first magnetic circuit, said second magnetic circuit having a second magnetic field with a second magnitude and a second direction orthogonal to the direction of the first magnetic field, wherein the magnitude and direction of the second magnetic field can be varied in a plane in which the two sets of corrugated dielectric image lines lie, and wherein the relative phases between each of said two sets of corrugated dielectric image lines in said second direction are controlled by varying the amplitude and direction of the second magnetic field, wherein by changing the amplitude and direction of the magnetic field of the first and second magnetic circuits, the radiation beam from the antenna array is steered.

11. The antenna of claim 10 wherein said first and second magnetic circuits are provided as two orthogonally disposed Helmholz coils.

12. The antenna of claim 11 wherein said two sets of corrugated dielectric image lines are fabricated from a wet etching technique.

13. An antenna comprising:

a waveguide horn antenna having first and second apertures;

a substrate having first and second opposing surfaces, said substrate disposed in a first one of the first and second apertures of the waveguide horn;

an array of ferrite discs disposed on a first one of the first and second surfaces of the substrate wherein the ferrite discs scatter radiation fields from said waveguide horn;

a first magnetic circuit disposed proximate said array of ferrite discs, said first circuit having a first magnetic field with a first magnitude and a first direction, said first magnetic field variable in the plane in which the ferrite discs are disposed, wherein relative phases between each of said ferrite discs in said first direction are controlled by varying the amplitude and direction of the first magnetic field;

a second magnetic circuit orthogonally disposed relative said first magnetic circuit, said second magnetic circuit having a second magnetic field with a second magnitude and a second direction orthogonal to the direction of the first magnetic field, said second magnetic field variable in the plane in which the ferrite discs are disposed, wherein relative phases between each of said ferrite discs in said second direction are controlled by varying the amplitude and direction of the second magnetic field, wherein by changing the amplitude and direction of the first and second magnetic fields, the magnetization state of the ferrite discs may be altered.

14. The antenna of claim 13 wherein said substrate is provided from teflon and said teflon substrate is disposed in front of the first aperture of said a waveguide horn antenna.

15. The antenna of claim 14 wherein said waveguide horn is responsive to signals in the millimeter wave frequency range.

16. The antenna of claim 15 wherein said antenna elements are provided as one of:

a microstrip patch;

a slot window;

a corrugated ridge; and a scattering element.

17. The antenna of claim 16 wherein said array of ferrite discs is a two dimensional array of ferrite discs.

18. The antenna of claim 17 wherein said means for applying an external magnetic field are two orthogonally disposed Helmholz coils wherein said two orthogonally disposed Helmholz coils provide the external magnetic field in the horizontal and vertical directions and wherein the external magnetic field alters the magnetization state of the ferrite discs thereby changing the direction of a main beam of said antenna array.

* * * * *